United States Patent [19]

Kubota et al.

[11] Patent Number: 4,645,513

[45] Date of Patent: Feb. 24, 1987

[54] PROCESS FOR MODIFICATION OF COAL

[75] Inventors: Katsuzo Kubota, Tokyo; Masayuki Nakai; Shigeyoshi Ono, both of Sodegaura, all of Japan

[73] Assignee: Idemitsu Kosan Company Limited, Tokyo, Japan

[21] Appl. No.: 747,652

[22] Filed: Jun. 21, 1985

Related U.S. Application Data

[63] Continuation of Ser. No. 540,831, Oct. 11, 1983, abandoned.

[30] Foreign Application Priority Data

Oct. 20, 1982 [JP] Japan ..... 57-182789
Mar. 7, 1983 [JP] Japan ..... 58-35928

[51] Int. Cl.[4] ..... C10L 5/00

[52] U.S. Cl. ..... 44/10 H; 264/83; 264/109

[58] Field of Search ..... 264/83, 109, 122; 44/1 G, 10 D, 10 H

[56] References Cited

U.S. PATENT DOCUMENTS

| | | | |
|---|---|---|---|
| 2,424,012 | 7/1947 | Bangham et al. | 264/330 |
| 3,686,384 | 8/1972 | Runton | 264/122 |
| 3,723,079 | 3/1973 | Seitzer | 44/1 R |
| 3,918,929 | 11/1975 | Schmalfeld et al. | 44/10 K |
| 3,980,447 | 9/1976 | Franke et al. | 44/10 D |
| 4,324,561 | 4/1982 | Dean et al. | 44/10 E |
| 4,396,394 | 8/1983 | Li et al. | 44/16 |
| 4,400,176 | 8/1983 | Kutta | 44/1 R |
| 4,402,706 | 9/1983 | Wunderlich | 44/16 |
| 4,403,996 | 9/1983 | Matsuura et al. | 44/16 |
| 4,508,539 | 4/1985 | Nakai | 44/10 D |

FOREIGN PATENT DOCUMENTS

| | | | |
|---|---|---|---|
| 0015189 | 8/1928 | Australia | 44/16 |
| 0082470 | 6/1983 | European Pat. Off. | 44/16 |
| 0149494 | 11/1981 | Japan . | |
| 0242352 | 5/1925 | United Kingdom | 44/10 H |
| 0407797 | 3/1934 | United Kingdom | 44/10 D |
| 2067732 | 7/1981 | United Kingdom . | |

*Primary Examiner*—Jan Silbaugh
*Assistant Examiner*—Mary Lynn Fertig
*Attorney, Agent, or Firm*—Frishauf, Holtz, Goodman & Woodward

[57] ABSTRACT

A process for upgrading the characteristics of moisture containing coal which comprises drying coal until the water content reaches substantially zero, rapidly heating the dried coal to a molding temperature of from 200° to 400° C. within a time of from 1 to 10 minutes, compression molding the dried coal under elevated pressure, oxidizing the molded coal and then steaming said oxidized molded coal in saturated moisture at from 80° C. to 150° C. from 2 to 8 hours to provide a dry upgraded coal having a decreased tendency to self-ignite.

13 Claims, No Drawings

PROCESS FOR MODIFICATION OF COAL

This is a continuation of application Ser. No. 540,831 filed Oct. 11, 1983, now abandoned.

FIELD OF THE INVENTION

The present invention relates to a process for modification of coal, and more particularly, to a process for stabilization of coal whereby the water content of low rank coals such as peat, brown coal, and sub-bituminous coal is decreased and furthermore their activity is reduced to prevent them from spontaneous combustion.

The present invention further relates to a process for modification of coal, and more particularly, to a process for modification of coal whereby the water content of low rank coals such as peat, brown coal, and sub-bituminous coal is decreased and furthermore in which the activity is reduced by application of rapid heating, compression molding, and oxidation in combination to prevent the coal from spontaneous combustion and also to improve the transfer and storage properties thereof.

BACKGROUND OF THE INVENTION

Low rank coal, such as brown coal, is generally used only in limited areas near collieries because its high water content increases the transfer cost, which is disadvantageous from an economic standpoint, and further it is liable to ignite spontaneously during the transfer or storage thereof because of its high activity.

Under such circumstances, various proposals have been made to decrease the water content of such a low rank coal and to prevent it from spontaneous combustion.

As techniques to decrease the water content of coal, (1) a vaporization method and (2) a mechanical dehydration method, for example, are known. Also, as techniques to prevent the spontaneous combustion of coal, (1) an air shielding method (such as coal storage in water, coating of coal surface, covering of coal surface, compressive storage of coal, and inert gas sealing), (2) a cooling method, (3) a method of removing fine coal powder, (4) a briquetting method, and so forth are known. In more detail, a method in which coal is dried, heated in the presence of steam, and heat molded under atmospheric presure to produce briquette (see Japanese Patent Application Laid-Open No. 104996/1981) and a method in which coal is dried, heated rapidly, and then cooled rapidly (see Japanese Patent Application Laid-Open No. 149494/1981) are known.

These methods, however, are not satisfactory since no sufficient effect can be obtained and the operation is complicated.

SUMMARY OF THE INVENTION

An object of the invention is to provide a process for the modification of coal whereby the dehydration of low rank (i.e., grade) coal and the prevention of the spontaneous combustion thereof are attained simultaneously by a relatively simplified procedure.

The present invention relates to:

(1) a process for modifying coal which comprises heating the coal at a temperature of from 100° to 350° C. until the water content reaches substantially zero and, thereafter, oxidizing the coal; and (2) a process for modifying coal which comprises drying the coal until the water content reaches substantially zero, rapidly heating the coal to a molding temperature, compression molding under elevated pressure, and then oxidizing the molded coal.

DETAILED DESCRIPTION OF THE INVENTION

It is known that of coals, peat is most easy to ignite spontaneously, and brown coal, sub-bituminous coal, are also easy to ignite spontaneously. The transfer (i.e., transport) efficiency of such low rank coals such as peat, brown coal, sub-bituminous coal, etc. is poor because of their high water contents. Thus the present invention is intended to modify mainly such low rank coals.

In the practice of the process of the invention, it is desirable for the coal feed to be ground in a granular form. It is especially preferred that the grain diameter be 3 millimeters or less. It is also desirable that the water content of the coal be decreased to from 15 to 20% by weight by drying such as drying in the sun.

The process (1) of the present invention is explained below.

Coal is first heated at a temperature of from 100° to 350° C. preferably in inert gas such as nitrogen gas until the water content reaches substantially zero. The time for this heat treatment is determined taking into account the type of coal, the heating temperature, and so forth; it is usually from 10 minutes to 3 hours. By this heat treatment steam and combustible gases are removed from coal, and the spontaneous combustibility of coal is improved. If, however, the heating temperature is higher than 350° C., the carbon dioxide-generating temperature drops and the amount of oxygen being absorbed increases; the desired effects can be obtained only insufficiently.

After the heating process, if desired, the coal is molded. This molding can be attained only by heating and compressing the coal which has been heated. If necessary, a binder such as wet tar and pitch can be used.

The oxidation process which is to be applied after the heat treatment is intended to improve the spontaneous combustibility (or self-ignition properties) of coal. This oxidation is usually performed while heating. The oxidation at a temperature ranging between 100° and 200° C. takes excellent effects. The oxidation process is performed at an oxygen concentration of at least 1% by volume, usually from 1 to 21% by volume, and preferably from 4 to 10% by volume for a period of from 30 minutes to 5 hours, preferably from 2 to 3 hours. In this oxidation process, air can be used, but it is desirable to use a mixture of oxygen and nitrogen in a given ratio.

Next the process (2) of the invention is explained in detail.

Coal is dried usually by heating at a temperature of from 85° to 150° C., preferably in the presence of inert gas such as nitrogen gas until the water content reaches substantially zero. The drying time is determined taking into account the type of coal, the heating temperature, and so forth. This drying removes almost of the moisture in the coal and further a part of combustible gases.

The thus-dried coal is then rapidly heated to an elevated temperature such as a temperature of from 200° to 400° C. This heat treatment is performed so that the predetermined temperature is reached within a time of from 1 to 10 minutes, preferably from 5 to 7 minutes. This rapid heating is performed for the reason that heating at elevated temperatures for long periods of time results in a reduction of moldability.

After the rapid heating, the coal is compression molded in a moment at a predetermined temperature, preferably at a temperature of from 200° to 400° C. under a pressure of from 1 to 5 tons per square centimeters, preferably from 2 to 3 tons per square centimeters. In such compression molding, it is usually necessary to add an external binder, such as pitch. In the present invention, however, it is not necessary to add such external binders because self-byproduced tar is utilized as a binder.

The coal thus compression molded at elevated temperatures is then oxidized. This oxidation is performed for the purpose of improving the self-ignition properties of coal. Oxidation conditions are the same as described for the oxidation process in the process (1) of the invention. After the oxidation process, it is desirable to apply steaming. This steaming is performed in a saturated moisture at from 80° to 150° C., preferably 90° C. for from 2 to 8 hours. These oxidation and steaming processes may be applied simultaneously.

The method of the invention markedly reduces the water content of coal and produces modified coal having improved spontaneous combustibility as compared with the original coal feed or briquette from Australia. The modified coal as produced by the method of the invention has a high calorific value and therefore is suitable for use as a fuel coal. In particular, the process (2) of the invention usually produces modified coal having a temperature for generation of 1% carbon dioxide of 115° C. or more, a compressive strength of at least 80 kilogram forth per centimeter (kgf/cm), and a bulk density of 1.1 grams per cubic centimeter (g/cm$^3$). Thus the modified coal is greatly improved in the spontaneous combustibility and dust-producing properties and, even if ground, can maintain the improved properties. Furthermore the transfer efficiency of the modified coal is very high since the compressive strength and bulk density are high. The steaming produces modified coal having a high water resistance; that is, the modified coal does not get out of shape even if exposed to rain and is easy to handle or store. Furthermore it increases the compressive strength of the modified coal.

The present invention is described in greater detail with reference to the following Examples and Comparative Examples.

EXAMPLES 1 TO 5

Two kilograms of Yallourn brown coal (ground to a grain diameter of 5 millimeters of less) from Australia which had been air-dried was charged to a packed column and dried by passing preheated nitrogen gas through the column at a rate of 2 liters per minute. Subsequently, after the predetermined temperature was reached, the coal was heated for 3 hours. At the end of the time, the coal was cooled down to room temperature, taken out of the column, and stored in a closed container. The water content of the brown coal was 0%. The water content was measured by the Total Moisture-Measuring Method (Heat Drying Method) as defined in JIS M8811-1976 in all the examples.

A packed column was charged with 200 grams of the above-heated brown coal, and a mixed gas of oxygen and nitrogen which had been adjusted to an oxygen concentration of 6% by volume was preheated and passed through the column at a rate of 500 milliliters per minute. After the predetermined temperature was reached, the coal was oxidized for 3 hours. At the end of the time, the temperature of the coal was lowered to room temperature, and then the coal was taken out of the column and stored in a closed container.

The above brown coal was ground and screened to obtain a fraction having a grain diameter range of from 0.15 to 0.5 millimeter and a fraction having a grain diameter range of 0.15 millimeter or less. For the former fraction, the $CO_2$ gas-generating temperature and the amount of oxygen absorbed were measured to evaluate its spontaneous combustibility. For the latter fraction, the ultimate analytical values, proximate analytical values, and calorific value are shown in Tables 1 and 2.

COMPARATIVE EXAMPLE 1 TO 5

The procedure of each of Examples 1 to 5 was repeated with the exception that the oxidation process was omitted. The results are shown in Tables 1 and 2.

TABLE 1

| | Heating Temperature (°C.) | Oxidation Temperature (°C.) | $CO_2$ Gas-Generating Temperature (°C.)*1 | | Amount of Oxygen Absorbed (cc $O_2$/g Coal) 100 hours*2 | | |
|---|---|---|---|---|---|---|---|
| | | | 0.5% | 1% | 40° C. | 50° C. | 70° C. |
| Example 1 | 150 | 150 | 109 | 118 | 3.0 | 3.8 | 9.7 |
| Example 2 | 200 | 150 | 110 | 120 | 3.3 | 5.8 | 13.0 |
| Example 3 | 250 | 150 | 97 | 108 | 3.7 | 6.9 | 15.0 |
| Example 4 | 300 | 150 | 98 | 106 | 4.7 | 9.0 | 17.7 |
| Example 5 | 350 | 150 | 94 | 103 | 7.3 | 12.7 | 28.2 |
| Comparative Example 1 | 150 | — | 95 | 105 | 3.8 | 6.6 | 12.7 |
| Comparative Example 2 | 200 | — | 92 | 103 | 5.3 | 7.5 | 16.0 |
| Comparative Example 3 | 250 | — | 87 | 98 | 7.8 | 11.1 | 19.8 |
| Comparative Example 4 | 300 | — | 87 | 95 | 13.5 | 17.5 | 29.0 |
| Comparative | 350 | — | 90 | 97 | 11.2 | 17.8 | 35.5 |

TABLE 1-continued

| | Heating Temperature (°C.) | Oxidation Temperature (°C.) | $CO_2$ Gas-Generating Temperature (°C.)*1 | | Amount of Oxygen Absorbed (cc $O_2$/g Coal) 100 hours*2 | | |
|---|---|---|---|---|---|---|---|
| | | | 0.5% | 1% | 40° C. | 50° C. | 70° C. |
| Example 5 | | | | | | | |

Note:
*1Coal in an air dried condition was ground and screened in the atmosphere to obtain a 60–150 mesh fraction. Then 50 grams of the said fraction was placed in a reactor (a lower absorption tube of a combustion type sulfur analytical apparatusfor petroleum products as defined in JIS K-2818), which was then soaked in an oil bath. The atmosphere in the tube was replaced wiDth oxygen by blowing it thereinto at a rate of 30 milliliterDs per minute from a lower portion thereof. After it was confirmed by gas chromatography that the atmosphere was almost replaced with oxygen, the temperature of the oil bath was increased at a rate of about 0.7° C. per minute while maintaining the oxygen flow rate as described above. The composition of gas whichwas generated was measured by gas chromatography at about 15 minute intervals.
*2A sample boat (made of aluminum) with 1–2 grams of the 60–150 mesh fraction placed therein was placed in a chamber. The atmosphere in the chamber and a cylinder was thoroughly replaced with oxygen (atmospheric pressure). When the temperature of the chamber reached to a measuring temperature, the experiment was started. The variation in pressure corresponding to the amount of oxygen absorbed by the fraction sample was detected by a manostat, and the oxygen was introduced from the cylinder into the chamber by means of an injection pump in an amount equal to the consumed one. The amount of oxygen absorbed was determined by the amount of oxygen decreased in the cylinder.

TABLE 2

| | Ultimate Analytical Values (daf base, wt %) | | | | | Proximate Analytical Values (wt %) | | | | Calorific Value (Kcal/kg, dry base) |
|---|---|---|---|---|---|---|---|---|---|---|
| | C | H | N | S | O | Water | Ash | Volatile Matter | Fixed Carbon | |
| Example 4 | 67.9 | 4.3 | 1.2 | 0.2 | 26.4 | 4.6 | 1.5 | 44.6 | 49.5 | 6290 |
| Comparative Example 4 | 69.3 | 4.7 | 1.3 | 0.2 | 24.5 | 5.0 | 1.3 | 43.8 | 49.9 | 6410 |
| Referencial Example*1 | 64.0 | 4.5 | 1.0 | 0.2 | 30.3 | 68.2*2 | 0.2*2 | 17.6*2 | 13.3*2 | 6000 |

Note:
*1Coal was dried at 50° C. under reduced pressure.
*2Values based not on the equilibrium moisture at 95% humidity as defined in JIS M8811-1976, but on the water content of coal (Run of Mine).

EXAMPLES 6 TO 10

In these examples, the influence of the oxidation time was examined. The procedure of Example 1 was repeated wherein the heating temperature was 200° C., the oxidation temperature was 150° C., the oxygen concentration was 6% by volume, and the oxidation time was changed as indicated in Table 3. The results are shown in Table 3.

TABLE 3

| Example | Oxidation Time (hours) | $CO_2$ Gas-Generating* Temperature (°C.) | |
|---|---|---|---|
| | | 0.5% | 1% |
| 6 | 0.5 | 101 | 110 |
| 7 | 1 | 103 | 113 |
| 8 | 2 | 109 | 118 |
| 9 | 3 | 110 | 120 |
| 10 | 5 | 107 | 119 |

Note:
*Same as in Table 1.

EXAMPLES 11 TO 15

In these examples, the influence of the oxygen concentration in the oxidation process was examined. The procedure of Example 1 was repeated wherein the heating temperature was 300° C., the oxidation temperature was 150° C., and the oxygen concentration was changed as indicated in Table 4. The results are shown in Table 4.

TABLE 4

| Example | Oxygen Concentration (vol. %) | $CO_2$ Gas-Generating Temperature (°C.)*1 | | Amount of Oxygen Absorbed (cc $O_2$/g coal) 100 hours*2 | | |
|---|---|---|---|---|---|---|
| | | 0.5% | 1% | 40° C. | 50° C. | 70° C. |
| 11 | 1 | 97 | 104 | 6.3 | 14.0 | 25.5 |
| 12 | 2 | 91 | 100 | 6.1 | 10.7 | 24.5 |

TABLE 4-continued

| Example | Oxygen Concentration (vol. %) | $CO_2$ Gas-Generating Temperature (°C.)*1 | | Amount of Oxygen Absorbed (cc $O_2$/g coal) 100 hours*2 | | |
|---|---|---|---|---|---|---|
| | | 0.5% | 1% | 40° C. | 50° C. | 70° C. |
| 13 | 4 | 98 | 107 | 4.2 | 8.1 | 21.0 |
| 14 | 6 | 98 | 106 | 4.7 | 9.0 | 17.7 |
| 15 | 10 | 84 | 91 | 4.5 | 7.9 | 16.4 |

Note:
*1, *2Same as in Table 1.

EXAMPLES 16 TO 20

In these examples, the influence of the oxidation temperature was examined. The procedure of Example 1 was repeated wherein the heating temperature was 300° C., the oxygen concentration was 6% by volume, and the oxidation temperature was changed as indicated in Table 5. The results are shown in Table 5.

TABLE 5

| Example | Oxidation Temperature (°C.) | $CO_2$ Gas-Generating Temperature (°C.)* | |
|---|---|---|---|
| | | 0.5% | 1% |
| 16 | 100 | 95 | 116 |
| 17 | 125 | 97 | 105 |
| 18 | 150 | 98 | 106 |
| 19 | 175 | 95 | 103 |
| 20 | 200 | 93 | 101 |

Note:
*Same as in Table 1.

COMPARATIVE EXAMPLES 6 AND 7

Coal (Yallourn brown coal) dried at 50° C. under reduced pressure (Comparative Example 6) and briquette from Australia (Comparative Example 7) were each ground and screened to obtain a fraction having a grain diameter range of from 0.15 to 0.5 millimeter. This fraction was tested for the $CO_2$ gas-generating temperature and the amount of oxygen absorbed. The results are shown in Table 6.

COMPARATIVE EXAMPLES 8 AND 9

The procedure of Example 1 was repeated wherein the heating temperature was 400° C. and the oxidation process was omitted (Comparative Example 8).

The procedure of Example 1 was repeated wherein the heating temperature was 400° C. and the oxidation temperature was 150° C. The results are shown in Table 6.

TABLE 6

| Comparative Example | $CO_2$ Gas-Generating Temperature (°C.)*1 | | Amount of Oxygen Absorbed (ml $O_2$/g Coal) 100 hours*2 | | |
|---|---|---|---|---|---|
| | 0.5% | 1% | 40° C. | 50° C. | 70° C. |
| 6 | 74 | 81 | 15.0 | 20.1 | 30.6 |
| 7 | 79 | 86 | — | 12.6 | — |
| 8 | 80 | 87 | 21.8 | 28.0 | 45.0 |
| 9 | 81 | 90 | 13.4 | 23.0 | 40.0 |

Note:
*1, *2Same as in Table 1.

EXAMPLES 21 TO 24

Yallourn brown coal was ground to a grain diameter of 3 millimeters or less and fully dried at 120° C. in a nitrogen gas atmosphere. Then 8 grams of the above-dried coal (the properties of which are shown in Table 7) was placed in a mold (inner diameter: 25 millimeters), rapidly heated to a predetermined molding temperature within the period as shown in Table 7, and molded in a moment under a compression pressure of 3 tons per square centimeters. The thus-obtained mold was then taken out of the mold and oxidized in a mixed gas of oxygen and nitrogen (the concentration of oxygen: 6%) at a temperature of 150° C. for 3 hours. At the end of the time, the molded coal was cooled to a room temperature, and was taken out and stored in a closed container. The results are shown in Table 8. The spontaneous combustibility of the modified coal was evaluated by the 1% $CO_2$ gas-generating temperature.

COMPARATIVE EXAMPLES 10 TO 17

The procedures of Examples 21 to 24 were each repeated with the exception that the oxidization process was omitted. The results are shown in Table 8.

TABLE 7

| (a) Proximate Analytical Data of Dry Coal (dry base) | |
|---|---|
| Ash | 1.2% by weight |
| Volatile Matter | 50.9% by weight |
| Fixed Carbon | 47.9% by weight |
| (b) Ultimate Analytical Data (dry ash free) | |
| Carbon | 64.0% by weight |
| Hydrogen | 4.5% by weight |
| Nitrogen | 1.0% by weight |
| Oxygen | 30.3% by weight |
| Sulfur | 0.2% by weight |

TABLE 8

| | Molding Conditions | | Results | | | |
|---|---|---|---|---|---|---|
| | Temperature-Raising Time (min) | Molding Temperature (°C.) | Moldability | 1% $CO_2$-Generating Temperature (°C.) | 1% $CO_2$-Generating Temperature*2 (°C.) | Collapse*1 Strength of Molded Coal (kg.f/cm) |
| Example 21 | 5 | 205 | good | 126 | 120 | 111 |
| Example 22 | 7 | 250 | good | 133 | 119 | 158 |
| Example 23 | 7 | 300 | good | 131 | 115 | 182 |
| Example 24 | 8 | 350 | good | 115 | 110 | 80 |
| Comparative Example 10 | 4 | 150 | unmoldable | — | — | — |
| Comparative Example 11 | 9 | 410 | unmoldable | — | — | — |
| Comparative Example 12 | 5 | 205 | good | 105 | 103 | 110 |
| Comparative Example 13 | 7 | 250 | good | 106 | 103 | 155 |
| Comparative Example 14 | 7 | 300 | good | 102 | 89 | 180 |
| Comparative Example 15 | 8 | 350 | good | 100 | 85 | 82 |
| Comparative Example 16 | 10 | 430 | unmoldable | — | — | — |
| Comparative Example 17 | 600 | 210 | unmoldable | — | — | — |

Note:
*1Measured at a compression rate of 20 millimeters per minute from the direction of diameter of the cylindrical mold. For standardization, the compressive strength per unit strength was determined by dividing each measured value by the thickness.
*2After grinding

EXAMPLES 25 TO 27

An oxidized molded coal was prepared by the same method as in Example 22 and placed in a flask containing distilled water. This flask was soaked in a hot bath maintained at 100° C., and the interior of the flask was saturated with steam by heating distillated water at 90° C. In this saturated steam atmosphere, the molded coal was subjected to steaming.

The thus-obtained molded coal was measured for the compressive strength and the water content (in Examples 26 and 27, measured after water soaking as described hereinafter). The compressive strength was calculated from the following equation:

$$\text{Compressive Strength (kg} \cdot \text{f/cm)} = \frac{\text{Compressive Strength of Sample (kg} \cdot \text{f)}}{\text{Thickness of Sample (cm)}}$$

where Compressive Strength of Sample=Compressive strength when the sample was compressed from the direction of diameter thereof.

In Examples 26 and 27, the molded coal was soaked in water for 100 hours and, thereafter, the compressive strength was measured. The retention rate was calculated from the following equation:

$$\text{Retention Rate (\%)} = \frac{\text{Compressive Strength of Sample after Soaking in Water}}{\text{Compressive Strength of Sample before Soaking in Water}} \times 100$$

The results are shown in Table 9.

EXAMPLES 28 TO 30

An oxidized molded coal was prepared by the same method as in Example 23 and was subjected to steaming in the same manner as in Examples 25 to 27 for a predetermined time. The thus-obtained molded coal was measured for the compressive strength and the water content (in Examples 29 and 30, measured after the water soaking as described above). For the molded coals of Examples 29 and 30, the retention rate was measured. The results are shown in Table 9.

TABLE 9

| Example | Steaming Time | Water-Soaking Time | Compressive Strength (kg.f/cm) | Retention Rate (%) | Water Content (%) |
|---|---|---|---|---|---|
| 25 | 8 | 0 | 158 | — | 2.1 |
| 26 | 8 | 100 | 145 | 92 | 7.5 |
| 27 | 4 | 100 | 114 | 72 | 8.5 |
| 28 | 8 | 0 | 182 | — | 1.8 |
| 29 | 8 | 100 | 175 | 96 | 7.0 |
| 30 | 4 | 100 | 142 | 78 | 8.0 |

REFERENTIAL EXAMPLE 1

An oxidized molded coal was prepared by the same method as in Example 22 and soaked in water for 100 hours without application of steaming. At the end of the time, the compressive strength of the coal was tried to measure, but could not be measured because the coal was swollen and collapsed. The water content after soaking in water was 12.5%.

REFERENTIAL EXAMPLE 2

An oxidized molded coal was prepared by the same method as in Example 23 and soaked in water for 100 hours without application of steaming. At the end of the time, the compressive strength of the coal was measured and found to be 128 kg.f/cm. The retention rate was 71%. The water content after soaking in water was 12.5%. Cracks were formed in the coal.

What is claimed is:

1. A process for upgrading the characteristics of moisture containing coal which comprises drying coal until the water content reaches substantially zero, rapidly heating the dried coal to a molding temperature of from 200° to 400° C. within a time of from 1 to 10 minutes, compression molding the dried coal under elevated pressure, oxidizing the molded coal and then steaming said oxidized molded coal in saturated moisture at from 80° C. to 150° C. from 2 to 8 hours to provide a dry upgraded coal having a decreased tendency to self-ignite and having a temperature for generation of 1% carbon dioxide of 115° C. or more, a compressive strength of at least 80 kilogram forth per centimeter (kgf/cm), and a bulk density of 1.1 grams per cubic centimeter (g/cm$^3$).

2. The process as claimed in claim 1, wherein the coal is a low rank coal.

3. The process as claimed in claim 1, wherein the coal is brown coal.

4. The process as claimed in claim 1, wherein the coal is dried by heating at a temperature of from 85° to 150° C.

5. The process as claimed in claim 1, wherein the compression molding is performed in a moment at a temperature of from 200° to 400° C. under a pressure of from 1 to 5 tons per square centimeter.

6. The process as claimed in claim 1, wherein the oxidation is performed at a temperature of from 100° to 200° C. and oxygen concentration of from 1 to 21% by volume.

7. The process as claimed in claim 1, wherein low rank coal is dried by heating at a temperature of from 85° to 150° C., wherein said compression molding is performed in a moment at a temperature of from 200° to 400° C. under a pressure of from 1 to 5 tons per square centimeter, and wherein said oxidation is performed at a temperature of from 100° to 200° C. and oxygen concentration of from 1 to 21% by volume.

8. The process as claimed in claim 7, wherein the molded coal is steamed in saturated moisture at from 80° to 150° C. for from 2 to 8 hours.

9. The process as claimed in claim 7, wherein the dried coal is rapidly heated to said molding temperature within a time of from 5 to 7 minutes.

10. The process as claimed in claim 9, wherein said molding is at a pressure of from 2 to 3 tons per square centimeter.

11. The process as claimed in claim 10, wherein the molded coal is steamed in saturated moisture at from 80° to 150° C. for from 2 to 8 hours.

12. The process as claimed in claim 11, wherein said coal is dried under a nitrogen atmosphere.

13. The process as claimed in claim 10, wherein said coal is dried under a nitrogen atmosphere.

* * * * *